US005861792A

United States Patent [19]

Ueda et al.

[11] Patent Number: 5,861,792

[45] Date of Patent: Jan. 19, 1999

[54] COIL COMPONENT AND METHOD OF STAMPING IRON CORE USED THEREFOR

[75] Inventors: Satoshi Ueda; Kazusa Mori, both of Matsusaka; Satoshi Umehara, deceased, late of Matsusaka, by Satoko Umehara, heiress; Masami Tsuji; Yoshiyuki Nishimura, both of Matsusaka, all of Japan

[73] Assignee: Matsushita Electric Industrial Co., Ltd., Osaka, Japan

[21] Appl. No.: 980,450

[22] Filed: Nov. 28, 1997

Related U.S. Application Data

[63] Continuation of Ser. No. 318,673, filed as PCT/JP94/00241, Feb. 17, 1994, published as WO94/19811, Sep. 1, 1994, abandoned.

[30] Foreign Application Priority Data

| | | | |
|---|---|---|---|
| Feb. 19, 1993 | [JP] | Japan | 5-030126 |
| Feb. 24, 1993 | [JP] | Japan | 5-035035 |
| Mar. 19, 1993 | [JP] | Japan | 5-059940 |
| Mar. 23, 1993 | [JP] | Japan | 5-063694 |
| Mar. 26, 1993 | [JP] | Japan | 5-067832 |
| Jun. 22, 1993 | [JP] | Japan | 5-150065 |

[51] Int. Cl.[6] ..... H01F 27/24

[52] U.S. Cl. ..... 336/234; 336/212; 336/216; 336/217

[58] Field of Search ..... 336/233, 216, 336/234, 217, 212

[56] References Cited

U.S. PATENT DOCUMENTS

| | | | |
|---|---|---|---|
| 4,100,521 | 7/1978 | Hori | 336/100 |
| 4,234,862 | 11/1980 | Prevotat | 336/5 |
| 4,520,556 | 6/1985 | Pasko, Jr. et al. | 336/234 |
| 4,602,236 | 7/1986 | Shelby et al. | 336/216 |
| 5,200,731 | 4/1993 | Tochio et al. | 336/198 |

FOREIGN PATENT DOCUMENTS

| | | | |
|---|---|---|---|
| 143-023 A | 5/1985 | European Pat. Off. | 336/234 |
| 1560537 | 1/1968 | France | 336/234 |
| 1560537 | 2/1969 | France | 336/212 |
| 3714915 | 6/1962 | Japan . | |
| 52-60661 | 5/1977 | Japan . | |
| 56-56632 | 5/1981 | Japan . | |
| 62-154626 | 10/1987 | Japan . | |
| 6-96963 | 4/1994 | Japan | 336/234 |
| 6-231961 | 8/1994 | Japan | 336/234 |
| 6-275450 | 9/1994 | Japan | 336/234 |

*Primary Examiner*—Michael L. Gellner
*Assistant Examiner*—Anh Mai
*Attorney, Agent, or Firm*—Stevens, Davis, Miller & Mosher, L.L.P.

[57] ABSTRACT

A miniaturized, thin coil component with enhanced heat radiation and decreased flux leakage includes an I-shaped laminate iron core having at opposite ends tapered surfaces, and a pair of C-shaped laminate iron cores having tapered surfaces adapted to be mated with the tapered surfaces of the I-shaped laminate iron core. The I-shaped laminate iron core and the C-shaped laminate iron cores are combined so that the I-shaped laminate iron core is pressed by the inner surfaces of the tapered surfaces of the pair of C-shaped iron cores. The iron cores used for the coil component are stamped by a process of positioning the C-shaped cores in opposition to each other perpendicular to the hoop width, shifting one of the C-shaped cores perpendicular to the hoop width, obliquely positioning the I-shaped core between the C-shaped cores and then successively stamping the iron core hoop.

9 Claims, 16 Drawing Sheets

FIG. 4(a)
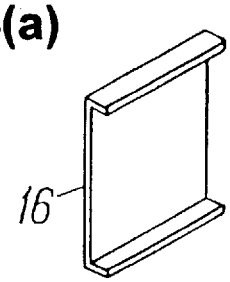
FIG. 4(b)
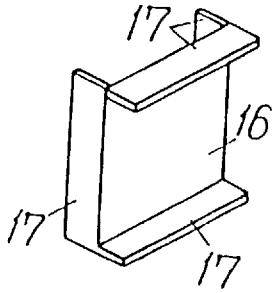
FIG. 4(c)
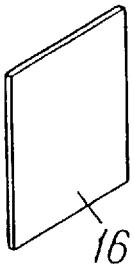
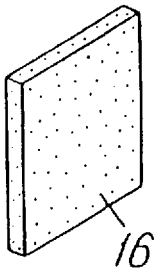
FIG. 4(d)

FIG. 19(a)
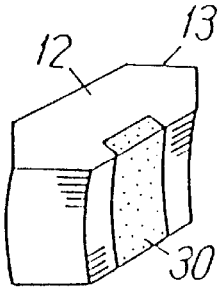
FIG. 19(b)
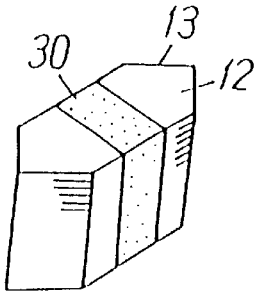
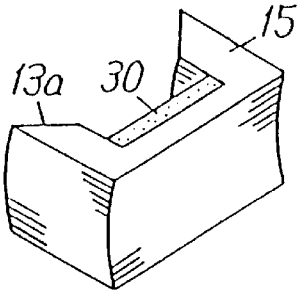
FIG. 19(c)
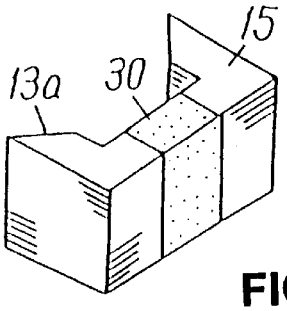
FIG. 19(d)

FIG. 20(a)
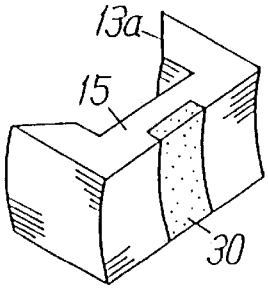
FIG. 20(b)
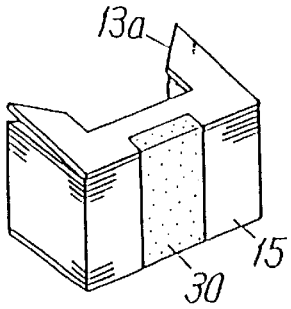
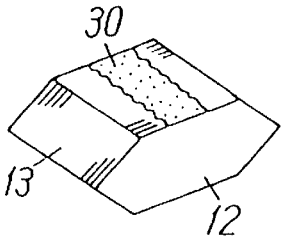
FIG. 20(c)
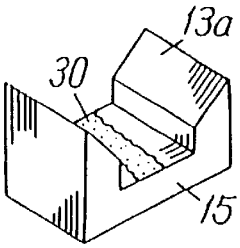
FIG. 20(d)

COIL COMPONENT AND METHOD OF STAMPING IRON CORE USED THEREFOR

This is a continuation of application Ser. No. 08/318,673, filed on Oct. 14, 1994 now abandoned, which is a 371 of PCT/JP94/00241 filed on Feb. 17, 1994, published as WO94/19811 Sep. 1, 1994.

TECHNICAL FIELD

The present invention relates to a coil component such as a transformer, a choke coil or the like used in various kinds of electronic equipment, and also relates to a method of stamping iron cores used therefor.

BACKGROUND ART

In recent years, coil components such as transformers, choke coils or the like used in various kinds of civilian electronic equipment, have been made thinner and shorter, and further have been desired to enhance their electric characteristics such as a low loss, low heat generation, high efficiency, and a low leakage flux. In this situation, it has been also required that they have structures which enhance productivity, and accordingly, a method of stamping iron cores, which is highly productive and economical, has been desired.

Among conventional coil components, a transformer as a conventional example, will be hereinbelow explained with reference to FIGS. 22 to 27. Referring FIGS. 22 and 23, windings 3 composed of a primary winding and a second winding are wound on a coil bobbin 2 having flanges at opposite ends thereof, and an E-shaped laminate iron core 4 having a predetermined thickness is inserted in the coil bobbin 2 while an I-shaped laminate iron core 5 having a predetermined lamination thickness is arranged so as to abut against the magnetic leg end side of the E-shaped laminate iron core 4. Then, the abutting parts of both iron cores 4, 5 are fixed together by welding or by using a metal frame or the like so as to form the transformer.

With the above-mentioned arrangement, as shown in FIGS. 24(*a*) and (*b*), the space required for the windings is inevitably small due to (a) the previous provision of a clearance A between (1) the windings 3 or the outer peripheral part of the coil bobbin 2 and (2) both outside magnetic legs of the E-shaped laminate iron core 4, which depends upon the direction of insertion of the E-shaped laminate iron core into the coil bobbin 2, and the clearance a between (1) the center hole of the coil bobbin 3 and (2) the center magnetic leg of the E-shaped laminate iron core 4, and (b) the necessity of a clearance B for deformation of the coil bobbin 2 caused by winding tension, or the like. Accordingly, this hinders the transformer from being minaturized and made thinner.

Further, with the provision of the above-mentioned clearances A and B, air layers are present between the windings 3 or the coil bobbin 2 and the E-shaped laminate iron core 4, causing heat radiation to deteriorate so that the temperature rise becomes steep and further possibly causing vibration. Accordingly, the reliability of the transformer is inferior.

Further, due to the use of the E-shaped laminate iron core 4 and the I-shaped laminated iron core 5 for the iron core of the transformer, the abutting parts of both iron cores 4, 5 are orthogonal to the magnetic flux so that the abutting parts serve as a magnetic gap. Accordingly, the leakage of magnetic flux through the abutting parts becomes excessive, resulting in difficulty in lowering the leakage of magnetic flux.

Further, since the clearances should be taken by a large degree as mentioned above, the windings 3 have to be wound in order or in line-up so as to effectively use the winding space at its maximum. Accordingly, the winding requires a large amount of manhours, and further, the cost of the winding machine therefore becomes expensive.

Further, as shown in FIG. 25; if the insertion angle of the E-shaped laminate iron core 4 into the coil bobbin 2 goes out of order, or if the outer diameter of the windings becomes excessively large as shown in FIG. 30, a corner of one of the magnetic legs of the E-Shaped laminate iron is likely to damage the outer surface of the windings 3 upon insertion of the E-shaped laminate iron core 4, causing deterioration of insulation. Accordingly, it is inferior with respect to safety.

As mentioned above, since the risk of increase in the diameter of the windings 3 would often occur, as shown in FIG. 27, the windings 3 are pressed on opposite sides with the use of winding shaping tools 6 so as to put the diameter of the windings in order after the formation of the windings 3. However, this shaping causes cracking and deformation of the coil bobbin 2 so as to incur secondary inferiority such as breakage or inferior insulation of the windings 3, that is, serious problems are raised with respect to reliability.

The present invention is devised in order to eliminate the above-mentioned disadvantages inherent to the conventional arrangement, and accordingly, one object of the present invention is to provide a coil part which is lightweight, thin and short, and which is excellent in electrical characteristics.

DISCLOSURE OF INVENTION

In order to solve the above-mentioned problems, according to the present invention, a coil component comprises an I-shape laminate iron core, as a center magnetic leg incorporated in the center part of windings, having at opposite ends triangular shape parts so as to have tapered surfaces on opposite sides thereof, and a pair of C-shape laminated iron cores, as opposite side magnetic legs, having at opposite ends tapered surfaces which are adapted to be mated with the tapered surfaces of the triangular shape parts of the I-shape laminate iron core, whereby the pair of C-shape laminate iron core are coupled to the I-shape laminated iron core so that the inner surfaces of the C-shape laminate iron cores press the outer surface of the windings toward the I-shape laminate iron core.

With this arrangement, the clearance between the windings and the iron core can be minimized so as to decease air layers, thereby it is possible to aim at decreasing the weight, thickness and length of the coil component and at enhancing the electric characteristics thereof.

BRIEF DESCRIPTION OF THE DRAWINGS

FIGS. 4(*a*) to (*d*) perspective views illustrating insulating sheets used in the transformer;

FIGS. 19(*a*) to (*d*) are perspective views illustrating iron cores which are essential parts of transformers in the several embodiments;

FIGS. 20(*a*) to 20(*d*) are perspective views illustrating iron cores which are essential parts of the transformers in the several embodiments;

BEST MODES FOR CARRYING OUT THE INVENTION

Embodiment 1

Explanation will be hereinbelow made of an embodiment of the present invention with reference to FIGS. 1 to 6.

Figure 1:
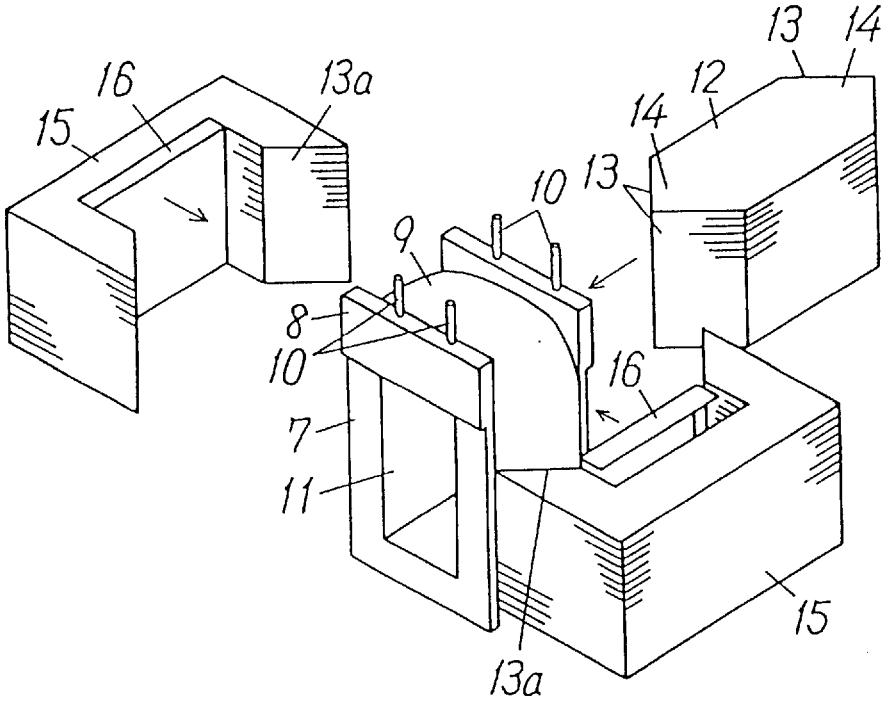
FIG. 1 is an exploded perspective view illustrating a transformer in one embodiment of a coil component according to the present invention.
Figure 2:
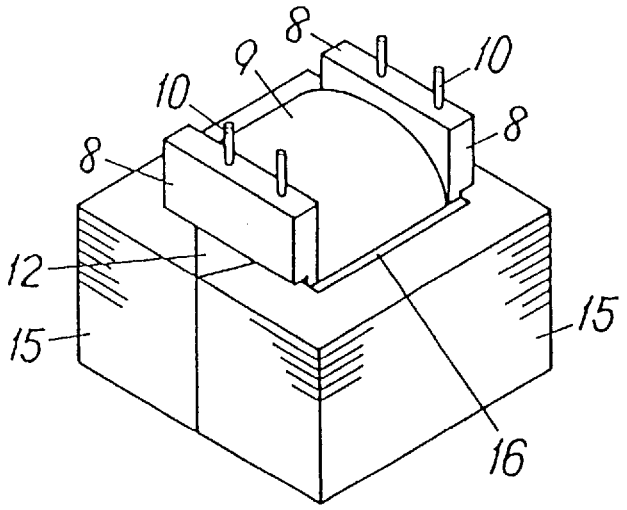
FIG. 2 is a perspective view illustrating the transformer shown in FIG. 1.
Figure 3A:
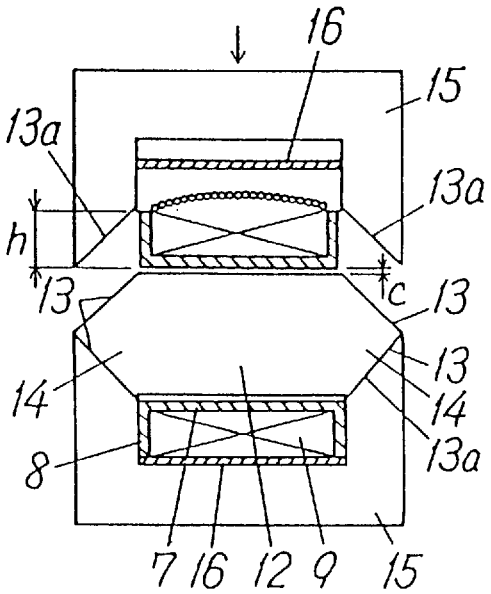
FIGS. 3(*a*) and (*b*) are sectional views for explaining clearances in the transformer.
Figure 3B:
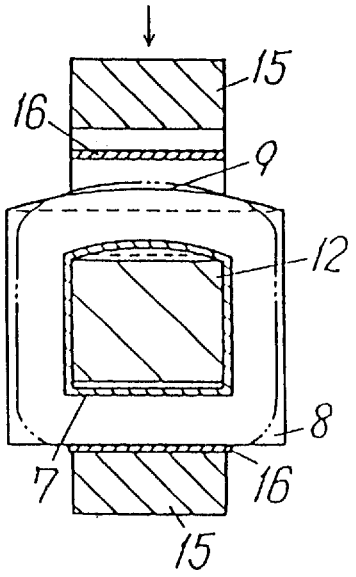

Referring, at first, to FIGS. 1 to 3(*b*), a transformer as a typical example of coil components will be explained. A coil bobbin 7 having flanges 8 at opposite ends is wound thereon with windings 9 consisting of at least a primary winding and a secondary winding. The winding-start part, intermediate taps and winding-end part of the windings 9 are connected to terminals 10 provided on the flanges 8 of the coil bobbin 7.

A lamination of I-shaped laminate iron cores 12, as a center magnetic leg, having a predetermined lamination thickness is fitted in a center hole 11 in the coil bobbin 7. The I-shaped laminate iron cores 10 are provided at opposite ends with triangular-shaped parts 14 having at opposite sides 45 degree-tapered surfaces 13.

Further, a pair of C-shaped laminate iron cores 15, as outside magnetic legs, having a predetermined lamination thickness are incorporated on opposite sides of the coil bobbin 7. Each of these C-shaped laminate iron cores 15 has at its opposite end parts tapered surfaces 13a adapted to be mated with the tapered surfaces 13 of the triangular shape parts 14 of the I-shaped laminate iron core 12. The incorporation of these C-shaped laminate iron cores 15 on both sides of the I-shaped laminate iron core 12 constitutes a θ-like shaped closed magnetic circuit iron core.

Further, during the incorporation of the C-shaped laminate iron cores 15 on both sides of the coil bobbin 7, insulating sheets 16 are laid on the inner surfaces of the C-shaped laminate iron cores 15 in order to ensure the insulation between the C-shaped laminate iron cores 15 and the windings 9.

Further, these C-shaped laminate iron cores 15 are sized and designed in such a way that they press the outer surface of the windings 9 wound on the coil bobbin 7 so as to cause the tapered surfaces 13a at both ends thereof to mate with the tapered surfaces 13 of the triangular-shaped parts 14 of the I-shaped laminate iron cores 12 when they are combined with the I-shaped laminate iron cores 12 on both sides of the coil bobbin 7. In such a condition that the C-shaped laminate iron cores 15 are made to abut against both sides of the I-shaped laminate iron cores 12, the abutting parts thereof are fixed by welding or by using a fastener so as to complete the transformer.

Clearances between the windings 9 and the iron cores in the above-mentioned structure will be explained with reference to FIGS. 3(*a*) and (*b*). The center hole 11 of the coil bobbin 7 has dimensions so that a clearance C with respect to the I-shaped laminate iron cores 12 is minimized, and the height h of the flanges 8 of the coil bobbin 7 is set to be equal to the size of an opening of the θ-like shaped closed magnetic circuit magnetic circuit iron core, which is formed by mating the tapered surfaces 13*a* of the C-shaped laminate iron cores 15 with the tapered surfaces 13 of the I-shaped laminate iron cores 12.

Accordingly, the windings 9 may be wound in disorder or out of line-up. Further, even though the diameter of the windings exceeds the height of the flanges 8 of the coil bobbin 7, the inner surfaces of the C-shaped laminate iron cores adapted to make contact with the windings 9 press and shape the outer surface of the windings 9 which are higher than the flanges 8 of the coil bobbin 7. Also, it is mated with the I-shaped laminate iron core 12 while correcting deformation of the coil bobbin 7 caused by the tension of the windings.

With the above-mentioned arrangement, even though gaps are present between loops of the windings 9, these gaps can be removed by the pressing force applied by the C-shaped laminate iron cores 15, and as a result, a transformer having only a clearance C between the coil bobbin 7 and the I-shaped laminate iron cores 12 may be provided.

Accordingly, Joule heat is efficiently radiated to the outside from the windings 9 through the iron cores.

It is noted that if the outer peripheral surfaces of the I-shaped laminate iron cores 12 are coated or painted with synthetic resin so as to form an insulating layer which may used instead of the coil bobbin 7, the clearance C can be eliminated so as to enhance the above-mentioned effect as to heat radiation.

Figure 5:
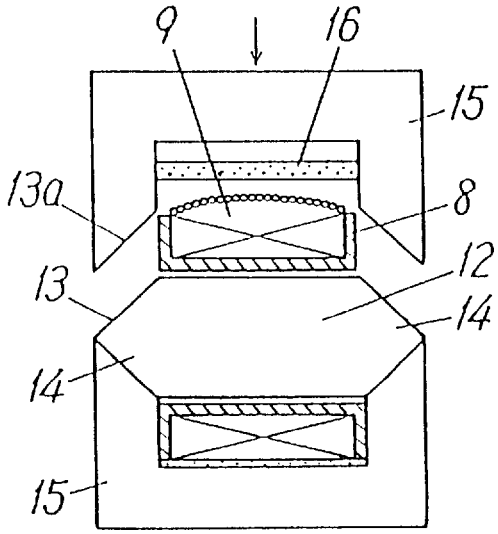
FIG. 5 is a sectional view illustrating a transform on the way of assembly thereof.
Figure 6:
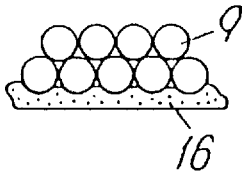
FIG. 6 is a sectional view for explaining the relationship between the insulating sheets and the windings which are essential parts of the transformer.

Further, the insulation sheets 16 may have various shapes as shown in FIGS. 4(*a*) to (*d*), that is, a U-like shape, a shape in which a rectangular piece formed at its four sides with bent pieces 17 with those at opposite sides bent in one direction, and the remaining ones bent in a direction reverse to the above-mentioned direction, a simple sheet-like shape or a shape having a large thickness. Also, sheet 16 may be made of a material which is excellent in heat-transmission and insulation, such as paper, unwoven fabric or a polyester film. In the case of using a sponge-like insulating sheet 16, as shown in FIG. 5, made of unwoven fabric or the like, the windings 9 can be pressed during the assembly of the C-shaped laminate iron cores, more elastically than in the case of using a insulating sheet 16 made of polyester, paper or the like, and accordingly, the cohesion between the insulating sheet 16 and the windings 9 can be enhanced so as to improve the heat radiation, thereby making it possible to minimize stress upon the windings 9.

Further, instead of the insulating sheet 16, the inner surfaces of the C-shaped laminate iron cores 15 may be coated or covered with an insulating material in order to provide the same effect.

Further, since the abutting surfaces of the I-shaped laminate iron core 12 and the C-shaped laminate iron cores 15 are tapered surfaces 13, 13*a* at angles of 45 deg. with respect to the direction of magnetic flux, the magnetic flux applied to the outside magnetic legs of the C-shaped laminate iron cores 15 is bent at right angles, and the areas of the abutting surfaces are about 1.4 times as large as that of the conventional one, that is, the areas of the abutting surfaces can be increased. Thus, leakage flux can be comparatively reduced even though magnetic gaps are formed between the abutting surfaces. It is noted that although it has been explained that the tapered surfaces 13, 13*a* have angles of 45 deg in the above-mentioned embodiment, the tapered surfaces should not be limited to have an angle of 45 deg. but may have any of various angles.

Figure 7:
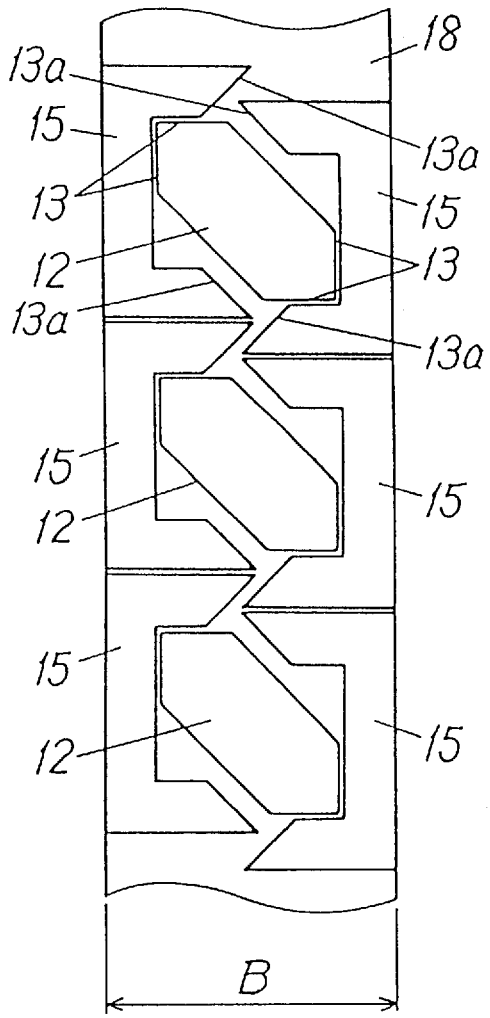
FIG. 7 is a plan view for explaining the stamping of iron cores which are essential parts of the transformer.

Further, FIG. 7 shows a method of stamping the I-shaped laminate iron cores and the C-shaped laminate iron cores 15, in which a pair of C-shaped laminate iron cores 15 are opposed to each other in a direction perpendicular to the hoop width B while one of the C-shaped laminate iron cores 15 is shifted perpendicular to the hoop width B, and the I-shaped laminate iron core 12 is positioned in the intermediate part between the opposed C-shaped laminate iron cores 15. In this condition, the iron core hoops 18 are successively stamped.

Explanation will be hereinbelow made of embodiments 2 to 5 in which like reference numerals are attached to those like to the parts in the embodiment 1 so as to omit the explanation to the like parts.

Embodiment 2

Figure 8:
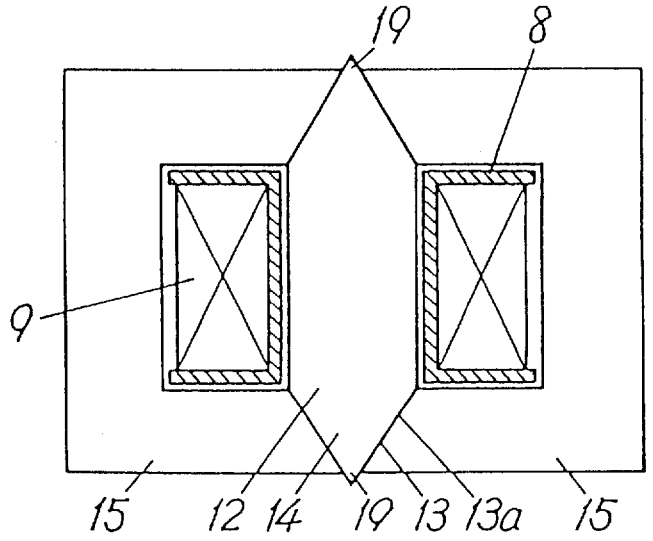
FIG. 8 is a sectional view illustrating I-shape and C-shape laminate iron cores in combination, which are essential parts of the transformer.

FIG. 8 shows a coil part having a θ-like shaped closed magnetic circuit structure in which the apex parts 19 of the triangular-shaped parts 14 of the I-shaped laminate iron cores 12, which are projected outward from the abutting parts of the C-shaped laminate iron cores 15 when the tapered surfaces 13 of the triangular-shaped parts 14 of the I-shaped laminate iron cores 12 at both ends thereof are mated with the tapered surfaces 13*a* of the C-shaped laminate iron cores 15 are welded in order to enhance the characteristics thereof.

Figure 9:
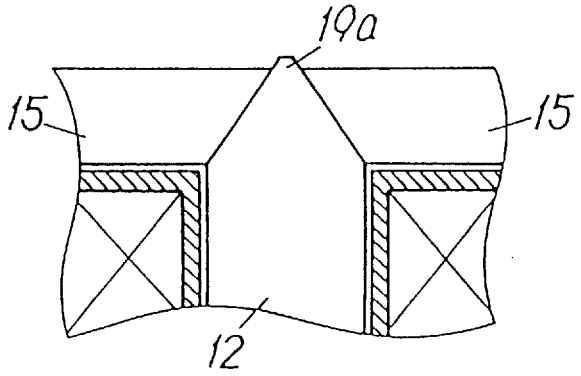
FIG. 9 is a section view illustrating abutting parts of I-shape and C-shape laminate iron cores which are essential parts of a transformer in another embodiment.

Further, as shown in FIG. 9, the apex parts 19*a* of the I-shaped laminated iron core 12 may have a trapezoidal shape in order to enhance the welding ability.

Figure 10:
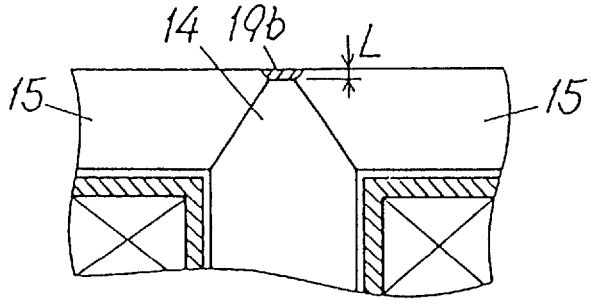
FIG. 10 is a sectional view illustrating the abutting parts which are essential parts of the transformer shown in FIG. 9, after welding.

By welding the apex parts 19 or 19*a* of the I-shaped laminate iron core 12 having a shape as shown in FIG. 8 or 9, the welding depth L of the apex parts 19*b* as shown in FIG. 10, can be smaller than one-half of the welding length of a core 12 having no apex parts 19. Magnetic effects such as hindrance of magnetic flux in the θ-like shaped closed magnetic circuit by welding can be minimized, and accordingly, the eddy-current loss at the apex parts 19*b* is reduced, thereby making it possible to aim at reducing magnetic loss and leakage.

Embodiment 3

Figure 11:
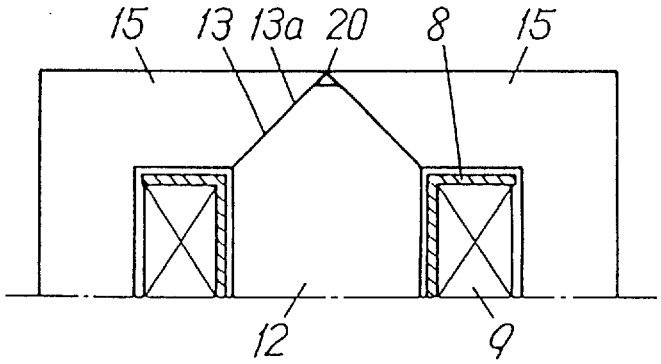
FIG. 11 is a sectional view illustrating abutting parts which are essential parts of a transformer in another embodiment according to the present invention.
Figure 13:
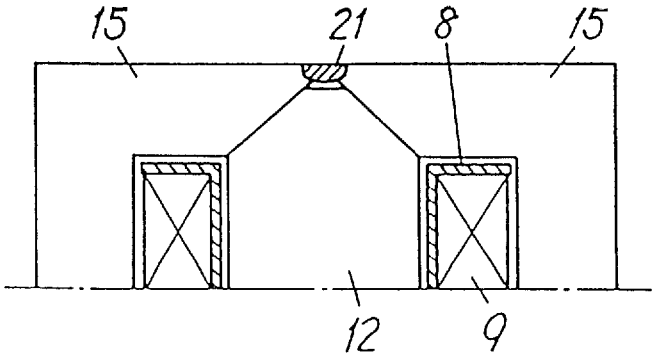
FIG. 13 is a sectional view illustrating the abutting parts which are essential parts of the transformer according to the present invention; after welding.

Next, FIG. 11 shows such an arrangement that the tip ends of the I-shaped laminate iron cores 12 are positioned inward from the abutting parts 20 of the C-shaped laminate iron cores 15 when the tapered surfaces 13 of the triangular-shaped parts of the I-shaped laminate iron cores 12 at both ends thereof are mated with the tapered surfaces 13*a* of the C-shaped laminate iron cores 15, thereby making it possible to enhance the welding ability and performance characteristics. In this arrangement, after the I-shaped laminate iron cores 12 are clamped between the C-shaped laminate iron cores 15, the abutting parts 20 shown in FIG. 11 are welded and fixed so as to obtain the welded parts 21 as shown in FIG. 13. Accordingly, the θ-like shaped closed magnetic circuit can be formed without the characteristics of the I-shaped laminate iron cores 15 being deteriorated by welding due to a two-point joint, so that the loss can be reduced and the welding can be facilitated, thereby making it possible to produce coil parts with a high degree of productivity.

Further, if a high grade iron core formed of a grain-oriented silicon steel sheet or the like is used as the I-shaped laminate iron core 12 while the C-shaped laminate iron cores 15 are formed of a non-oriented silicon steel sheet, the iron loss of the C-shaped laminate iron cores 15 becomes equal to that made of the grain-oriented silicon steel sheet. Accordingly, the leakage flux can be reduced since the C-shaped laminate iron cores 15 are made of a non-oriented silicon steel sheet. Further, the welding can be facilitated since the C-shaped laminate iron cores 15 are made of a non-oriented silicon steel sheet.

Figure 12:
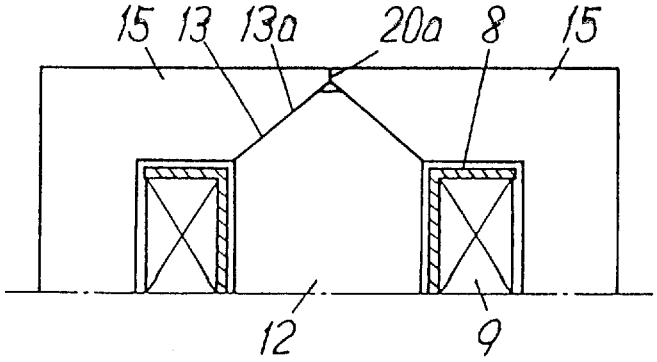
FIG. 12 is a sectional view illustrating abutting parts which are essential parts of a transformer in another embodiment according to the present invention.

Further, the abutting parts 20 can be formed as shown in FIG. 12 in which straight parts are formed at the tip ends of the tapered surfaces 13*a* of the C-shape laminate iron cores 15 so as to form flat surface abutting parts 20*a* which are then welded together as shown in FIG. 13.

Embodiment 4

Figure 14:
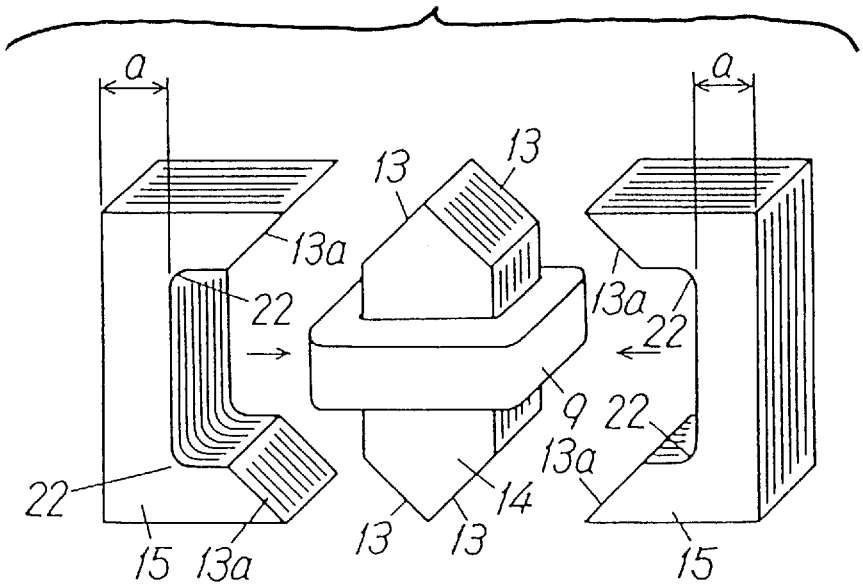
FIG. 14 is an exploded perspective view illustrating a transformer in another embodiment.

FIG. 14 shows an arrangement which aims at enhancing the characteristics and at enhancing the durability of press dies for the iron cores, in which rounded parts having a radius of curvature (which will be hereinbelow simply denoted as "radius R23") of a/50 to a/5 where a is the width of the magnetic legs of the pair of C-shape laminate iron core 15 are formed in the C-shaped laminate iron core at the inside corners 22 thereof. The larger the radius R23 at the inside corners, the more preferable if the windings 19 can be snugly held between the C-shaped laminate iron cores 15. Further, it dose not matter if only one of the inside corners is rounded.

With the magnetic circuit having a structure as mentioned above, since magnetic flux readily runs through the inside corners 22 of the C-shaped laminate iron cores 15 with a high magnetic flux density, leakage can hardly occur so as to reduce the exciting current, iron loss and leakage flux. As a result, the efficiency is increased so that the temperature rise can be restrained, and accordingly, the coil component can be miniaturized, thereby making it possible to eliminate the necessity of using iron cores having a large content of silicon, the necessity of annealing iron cores, and the necessity of attachment of a magnetic shield or a shot-ring. Further, it is possible to enhance the durability of press dies to be used for iron cores.

Figure 15:
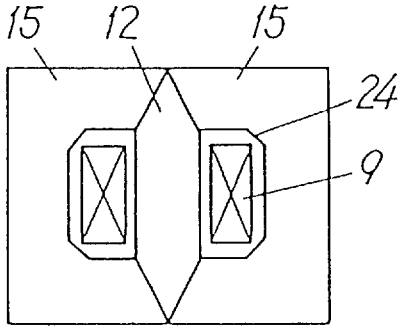
FIG. 15 is a sectional view illustrating a transformer in another embodiment.
Figure 16:
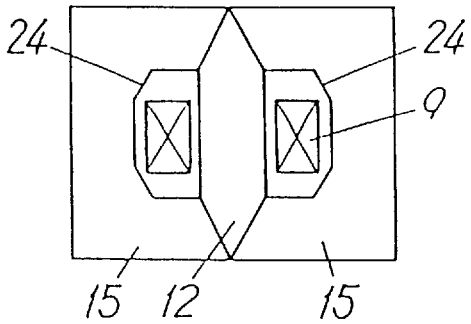
FIG. 16 is a sectional view illustrating a transformer in another embodiment.

FIGS. 15 and 16 shows such arrangements that tapered parts 24 are formed at the inside corners 22 of C-shaped laminate iron cores 15. With this arrangement, similar effects can be obtained.

Embodiment 5

Figure 17:
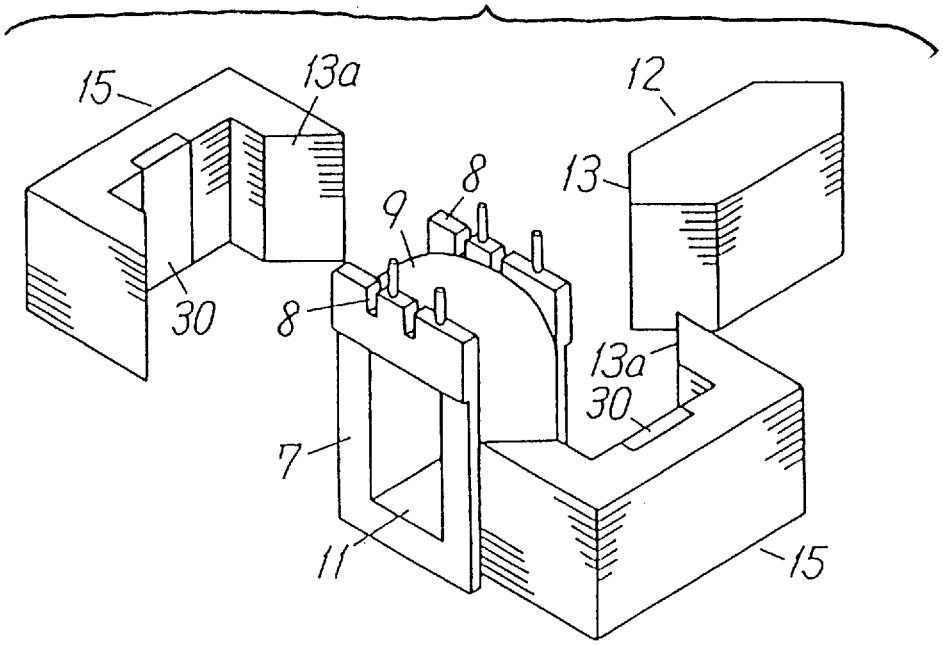
FIG. 17 is an exploded perspective view illustrating a transformer in another embodiment.
Figure 18:
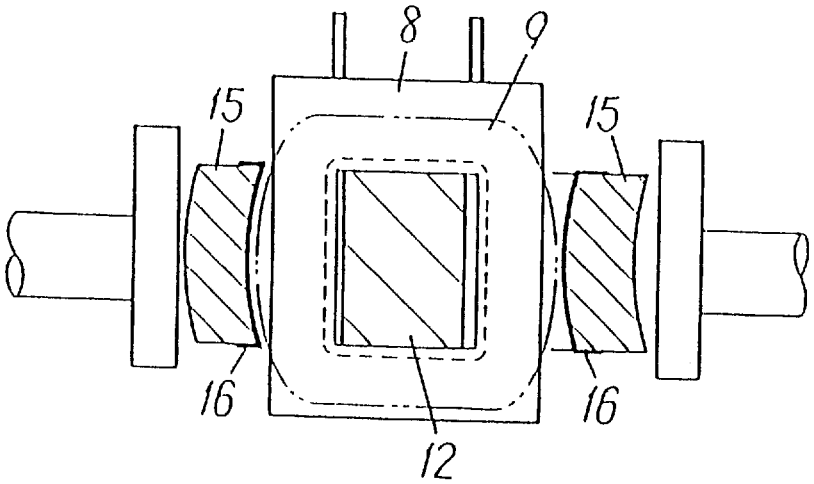
FIG. 18 is a sectional view for explaining steps of pressing and assembling of a transformer in another embodiment.
Figure 21:
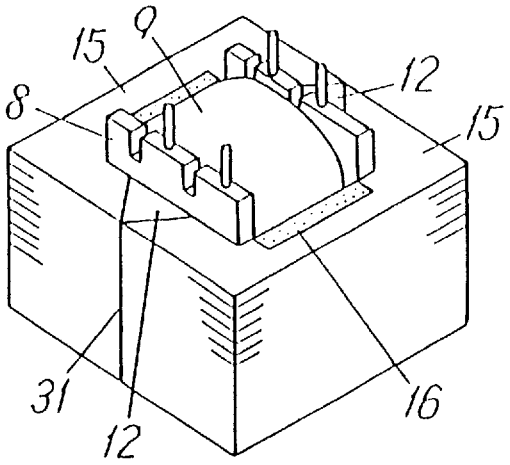
FIG. 21 is a perspective view illustrating a transformer in another embodiment.
Figure 22:
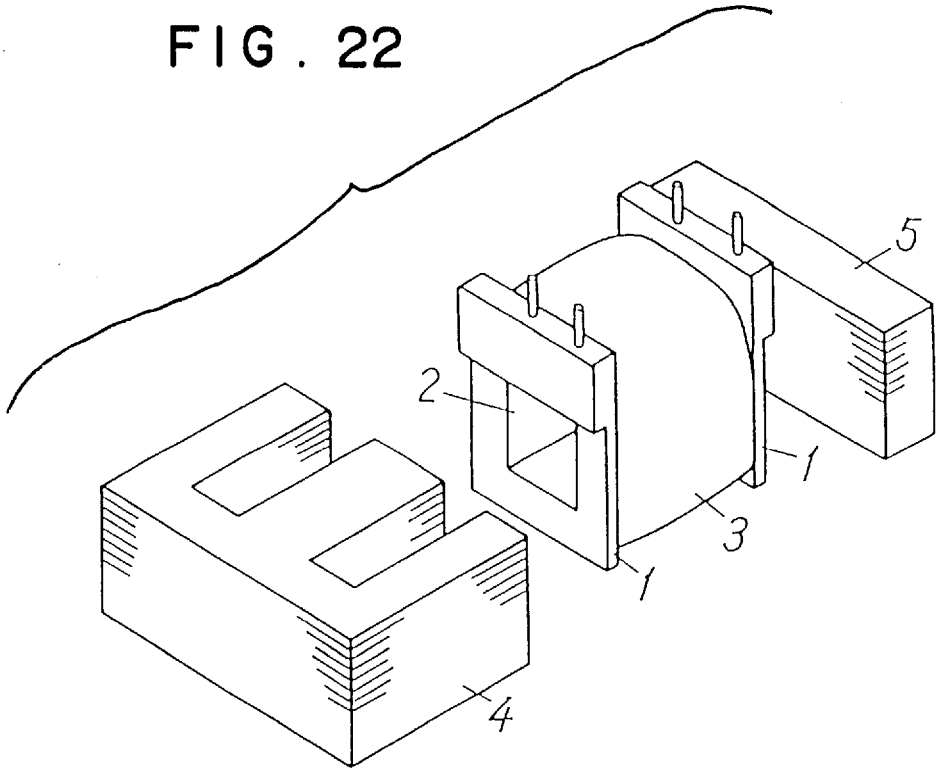
FIG. 22 is an exploded perspective view illustrating a transformer as a conventional coil component.
Figure 23:
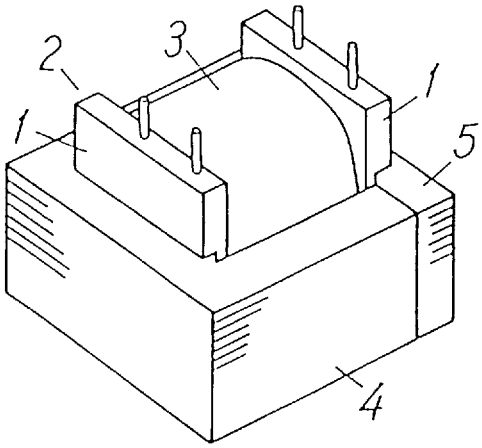
FIG. 23 is a perspective view illustrating the transformer shown in FIG. 22.
Figure 24A:
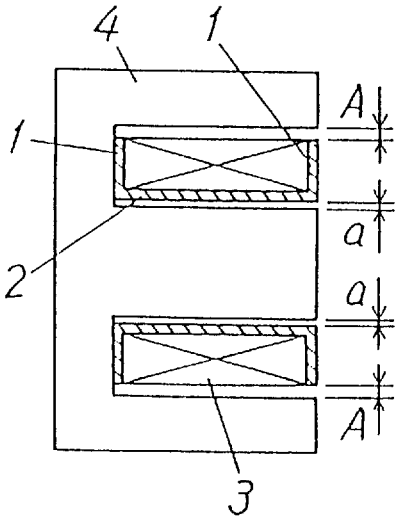
FIGS. 24(*a*) and (*b*) are sectional views illustrating the transformer.
Figure 24B:
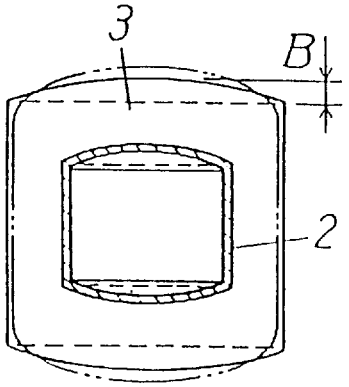
Figure 25:
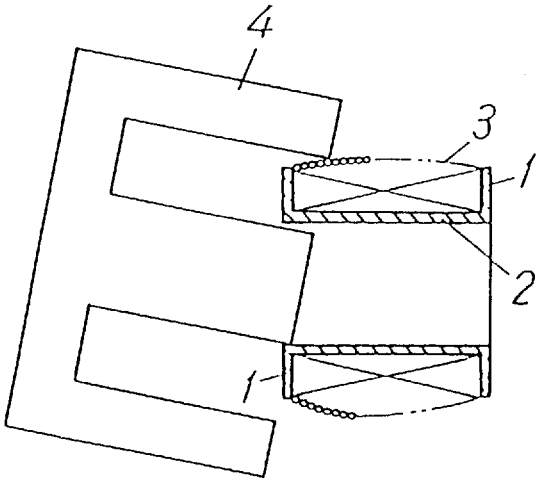
FIG. 25 is a sectional view for explaining a condition in which an E-shaped laminate iron core that is an essential part of the transformer is inserted into a coil bobbin.
Figure 26:
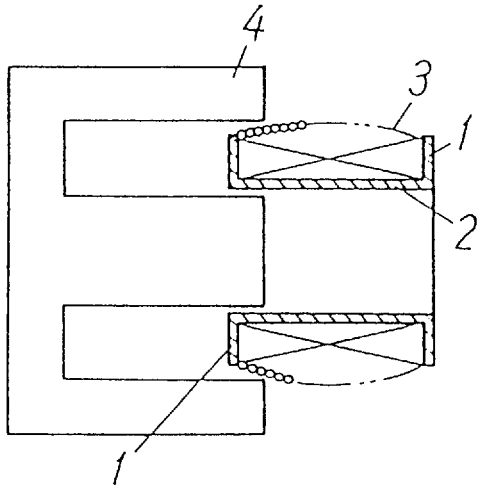
FIG. 26 is a sectional view for explaining a condition in which an E-shaped laminate iron core that is an essential part of the transformer is inserted into a coil bobbin.
Figure 27:
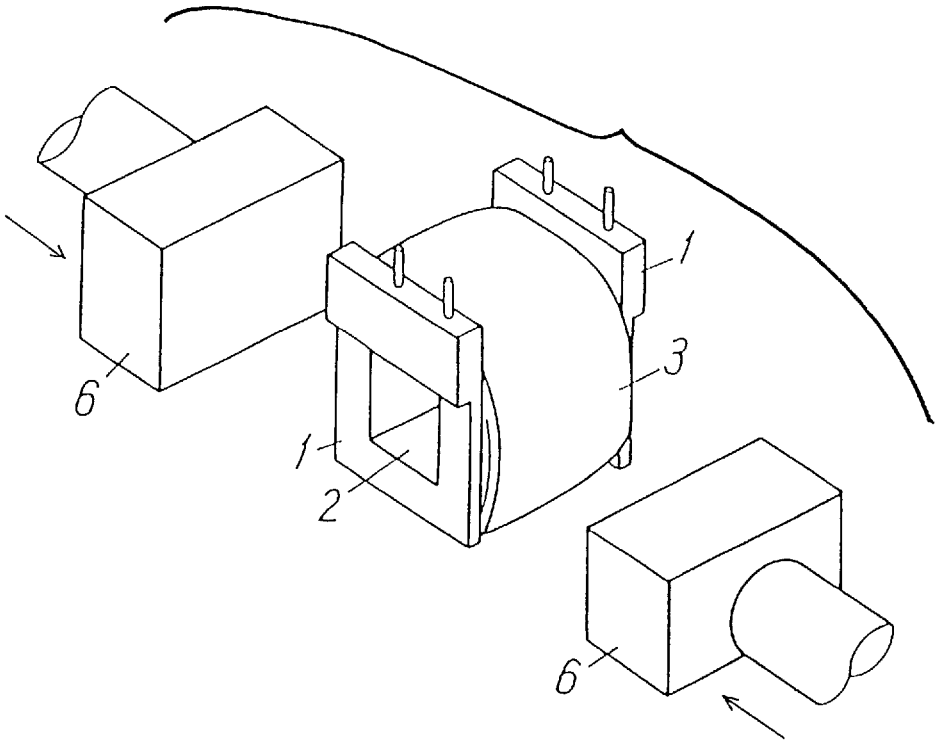
FIG. 27 is a perspective view for explaining steps of pressing and assembling the transformer.

FIG. 17 shows an arrangement which aims at enhancing the assembling ability and quality. In this arrangement, the I-shaped laminate iron cores 12 are laminated and are then inserted into the center hole 11 of the coil bobbin 7. A pair of C-shaped laminate iron cores 15, which have at opposite ends tapered surfaces 13*a* adapted to be mated with the tapered surfaces 13 of the above-mentioned I-shape laminate iron cores 12 and inner surfaces adapted to make contact with the windings 9 and flexibly fixed in block by binder 25, are incorporated from the upper surface of the windings 9. Then, points 31 where the tip ends of the tapered surfaces 13 of the I-shaped laminate iron cores 12 are mated with the C-shaped laminate iron cores 15 are welded so as to obtain a finished product shown in FIG. 21. In this method, a not-so-high degree of accuracy is required for the end surface of the lamination since it is flexibly fixed in block. Further, due to pressing during the assembly as shown in FIG. 18, the tapered surfaces 13, 13*a* are placed into close contact with each other so as to enhance the characteristics and to suppress beat frequency vibration. Further, since the laminate iron cores are pressed piece-by-piece, press dies therefor can have a simple structure so that the rotational speed of the press machine can be increased, thereby making it possible to reduce manufacturing costs.

As shown in FIGS. 19(*a*) to 20(*d*), the flexible method with the use of the binder 25, should not be limited to be applied for the inner surfaces of the pairs of I-shaped laminate iron cores 15, but can be applied for any other parts other than the tapered surfaces. Further, the I-shaped laminate cores 12 can similarly be flexibly fixed in block. As to the C-shaped laminate iron cores 15, since the fixing only at the outer surfaces causes the opening of the tapered surfaces in view of their shape, the fixing at surfaces which make contact with the windings 9 is effective. A polyester adhesive tape, a non-magnetic metal film such as an aluminum film applied thereon with adhesive, molten mold resin, rubber or acrylic glue or the like can be used as the binder 25. These materials can exhibit substantially identical effects.

INDUSTRIAL USABILITY

Since the coil component according to the present invention is formed as mentioned above, the clearances between the windings, the coil bobbin and the iron cores can be reduced so that the formation of air layers therebetween can be minimized. As a result, it is possible to remarkably enhance the space factor of the windings and the heat radiation.

In particular, since the insulation sheets are interposed between the inner surfaces of the C-shaped laminate iron cores and the outer surfaces of the windings so as to press the outer peripheral part of the windings, the air layers can be further reduced, and occurrence of vibration such as beat frequency vibration can be minimized. Further, since the I-shaped laminate iron cores and the C-shaped laminate iron cores are made to abut against one another with the use of the tapered surfaces, occurrence of leakage flux can be remarkably reduced, thereby making it possible to exhibit sufficient effects even with respect to the arrangement of recent electronic equipment having a high package density.

Further, since no damage is caused to the windings during assembly, reliability is excellent in view of the insulation.

Further, in such an arrangement that the tip ends of the triangular-shape parts of the I-shaped laminate iron cores are positioned and welded outward or inward of the abutting parts of the C-shaped laminate iron cores, it is possible to aim at reducing eddy-current loss due to welding, lowering loss, enhancing the efficiency and lowering the leakage flux. Further, even though the material of the I-shaped laminate iron core is made to be different from that of C-shaped laminate iron cores so as to lower the loss and leakage flux, it is possible to aim at enhancing the workability for welding and stabilizing quality, thereby enabling excellent productivity.

Further, in such an arrangement that the inside corners of the C-shaped laminate iron cores having a high flux density are rounded or tapered, the flux can easily run so that it can hardly leak. Thus, it is possible to restrain the temperature rise so that the miniaturization of the coil component can be made, and to eliminate the necessity of using iron cores having a large content of silicon, and the use of an annealing process so that the manufacturing cost can be reduced, that is, it is economical. Further, it is possible to enhance the durability of press dies used therefor.

Further, in such an arrangement that the I-shaped block iron core and the C-shaped block iron cores are flexibly fixed by a flexible binder, they are not separated into pieces during the assembly so that the workability is excellent, and further, the windings can be pressed by the inner surfaces of the C-shape laminate iron cores in its entirety so that the windings can be prevented from being damaged. Further, since a large space can be obtained for the winding, not only miniaturization and thinning can be made but also the necessity of a high degree of dimensional accuracy can be eliminated due to the flexibly fixed iron core blocks. Further, each piece of the iron core has freedom so as that a required degree of accuracy can be obtained by pressing during welding, and further, the iron cores can be surely joined one-by-one. Thus, it is possible to enhance the characteristics, and to eliminate inferior beat and inferior dimensions of iron core blocks.

Further, since the rotational speed of the press machine can be increased, several advantages including enhanced productivity of the iron cores can be offered.

It is claimed:

1. A coil component comprising:

a coil bobbin having opposite ends each having a flange;

an electrical winding wound on said coil bobbin;

an I-shaped laminate iron core having first and second triangular-shaped ends having at opposite sides thereof tapered surfaces;

a pair of one-piece C-shaped laminate iron cores each having first and second ends having tapered surfaces mated respectively in direct surface-to-surface contact with the tapered surfaces of the triangular-shaped ends of said I-shaped core, said pair of C-shaped cores being combined with said I-shaped core, said I-shaped core being positioned as a center magnetic leg incorporated in a center part of said winding, and said pair of C-shaped cores being opposite side magnetic legs disposed outside said winding and on opposite sides of said winding; and a pair of insulation sheets respectively interposed between inner surfaces of said C-shaped cores and an outer surface of said winding, the inner surfaces of said pair of C-shaped cores pressing said insulation sheets against the outer surface of said winding, wherein any part of said winding extending beyond an outer edge of said flange is flattened by contact with one of said insulation sheets.

2. A coil component as set forth in claim 1, wherein tip portions of said triangular-shaped ends project outward from and are welded to abutting ones of said tapered surfaces of said pair of C-shaped cores so as to form a θ-like shaped closed magnetic circuit.

3. A coil component as set forth in claim 1, wherein tip portions of said triangular-shaped ends are positioned inward of abutting ones of said tapered surfaces of said pair of C-shaped cores, and the abutting tapered surfaces of said C-shaped cores are welded together so as to form a θ-like shaped closed magnetic circuit with said I-shaped core.

4. A coil component as set forth in claim 3, wherein said I-shaped core is made of a different material from that of said C-shaped cores, and the abutting ones of said tapered surfaces of said C-shaped cores are welded together so as to form a θ-like shaped closed magnetic circuit.

5. A coil component as set forth in claim 1, wherein said pair of C-shaped cores have inside corners which are rounded with a radius curvature of a/50 to a/4 where a is a width of said opposite side magnetic legs provided by said C-shaped cores.

6. A component as set forth in claim 1, wherein said pair of C-shaped cores have tapered surfaces formed at inside corners of the opposite side magnetic legs provided by said pair of C-shaped cores.

7. A coil component as set forth in claim 1, wherein inside end parts of said C-shaped cores are flexibly fixed in block by a binder, and said I-shaped core and said C-shaped cores are combined such that the outer surface of said winding is pressed against said I-shaped core by the inner surfaces of said C-shaped cores.

8. A coil component as set forth in claim 1, wherein said C-shaped cores and said I-shaped core are flexibly fixed in block by a binder at end surfaces other than said tapered surfaces.

9. A method of stamping iron cores adapted to be used for a coil part including a lamination of I-shaped laminate iron cores each having first and second triangular-shaped ends and a pair of C-shaped laminate iron cores having tapered surfaces for mating with tapered surfaces of said triangular-shaped ends of said I-shaped cores, said method comprising:

positioning said pair of C-shaped cores in opposition to each other perpendicular to the hoop width, shifting one of said pair of C-shaped cores perpendicular to the hoop width, obliquely positioning said I-shaped core between inner parts of said opposed C-shaped cores, and thereafter successively stamping the iron core hoop.

* * * * *